US011733622B2

(12) United States Patent
Nakajima et al.

(10) Patent No.: US 11,733,622 B2
(45) Date of Patent: Aug. 22, 2023

(54) IMAGING SYSTEM WITH STEERING ROLLER ACTUATOR

(71) Applicant: HEWLETT-PACKARD DEVELOPMENT COMPANY, L.P., Spring, TX (US)

(72) Inventors: Kensuke Nakajima, Kanagawa (JP); Satoru Hori, Kanagawa (JP); Yuji Aoshima, Kanagawa (JP)

(73) Assignee: Hewlett-Packard Development Company L.P., Spring, TX (US)

( * ) Notice: Subject to any disclaimer, the term of this patent is extended or adjusted under 35 U.S.C. 154(b) by 0 days.

(21) Appl. No.: 17/779,749

(22) PCT Filed: Oct. 20, 2020

(86) PCT No.: PCT/US2020/056435
§ 371 (c)(1),
(2) Date: May 25, 2022

(87) PCT Pub. No.: WO2021/108044
PCT Pub. Date: Jun. 3, 2021

(65) Prior Publication Data

US 2023/0106182 A1 Apr. 6, 2023

(30) Foreign Application Priority Data

Nov. 29, 2019 (JP) ..... 2019-217206

(51) Int. Cl.
*G03G 15/00* (2006.01)
*G03G 15/16* (2006.01)

(52) U.S. Cl.
CPC ..... *G03G 15/1615* (2013.01)

(58) Field of Classification Search
CPC ..... G03G 15/00; G03G 15/20; G03G 15/1615
USPC ..... 399/159, 162, 165, 302, 308
See application file for complete search history.

(56) References Cited

U.S. PATENT DOCUMENTS

| | | | |
|---|---|---|---|
| 8,054,327 | B2 | 11/2011 | Satoh et al. |
| 2007/0035080 | A1 | 2/2007 | Yamada et al. |
| 2010/0189475 | A1 | 7/2010 | Atwood et al. |
| 2011/0150541 | A1 | 6/2011 | Michibata |
| 2013/0322934 | A1 | 12/2013 | Hatano |

FOREIGN PATENT DOCUMENTS

| | | | |
|---|---|---|---|
| JP | 2004203567 | * | 7/2004 |
| JP | 2008-76999 | A | 4/2008 |
| JP | 2008-170478 | A | 7/2008 |

(Continued)

*Primary Examiner* — Hoan H Tran
(74) *Attorney, Agent, or Firm* — Foley & Lardner LLP

(57) ABSTRACT

An imaging system includes a belt roller extending in an axial direction, an endless belt to rotate about the belt roller, a steering roller located inside the endless belt and extending in the axial direction, a steering roller actuator located at an end portion of the belt roller in the axial direction to contact the endless belt, and a support. The steering roller actuator is displaceable in the axial direction in response to a shifting of the endless belt so as to tilt the steering roller with respect to the axial direction. The support supports the endless belt in a gap formed between the belt roller and the steering roller actuator when the steering roller actuator is displaced in the axial direction.

15 Claims, 12 Drawing Sheets

(56) References Cited

FOREIGN PATENT DOCUMENTS

| | | | | |
|---|---|---|---|---|
| JP | 2015-129896 | A | | 7/2015 |
| JP | 2016-80875 | A | | 5/2016 |
| JP | 2018112623 | | * | 7/2018 |

* cited by examiner

IMAGING SYSTEM WITH STEERING ROLLER ACTUATOR

BACKGROUND

Some imaging apparatuses include a transfer unit which transfer a toner to a printing medium. The transfer unit includes an intermediate transfer belt to which a toner is transferred. The intermediate transfer belt is an endless belt that is suspended on a belt roller functioning as a drive roller, and a suspension roller, and that rotates in accordance with the rotational driving of the belt roller. The imaging system includes a steering roller which is located inside the endless belt and the steering roller is tilted when the endless belt meanders (or shifts) from the belt roller. In this way, the meandering of the endless belt is corrected when the steering roller is tilted inside the endless belt.

DETAILED DESCRIPTION

In the following description, with reference to the drawings, the same reference numbers are assigned to the same components or to similar components having the same function, and overlapping description is omitted. An imaging system may include an imaging apparatus such as a printer or the like, according to some examples, or a device or system within an imaging apparatus such as a belt driving device according to other examples.

Figure 1:
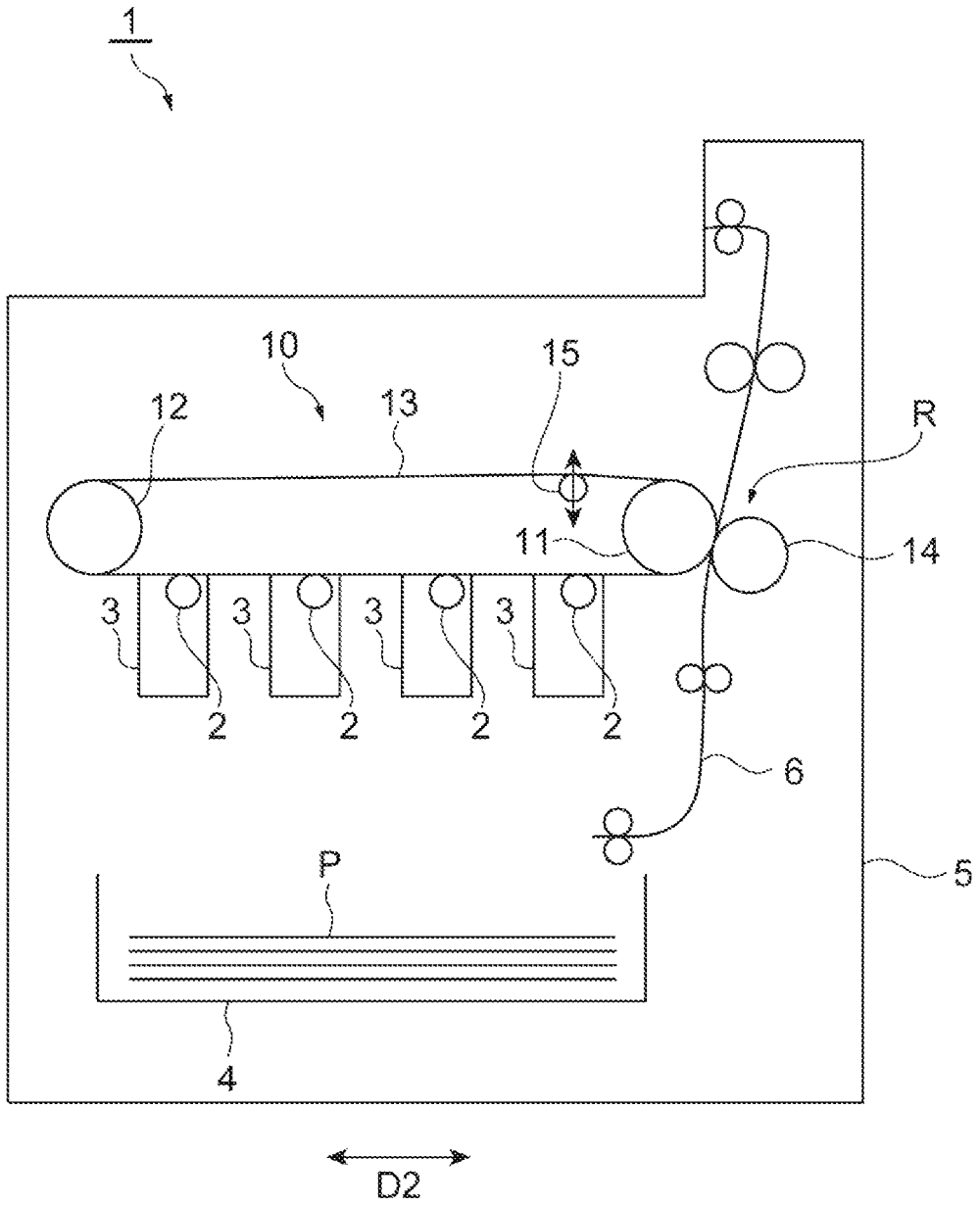
FIG. 1 is a diagram schematically illustrating a configuration of an example imaging system.

With reference to FIG. 1, an example imaging apparatus 1 will be described. The example imaging apparatus 1 may be, for example, a color imaging apparatus including a belt driving device 10 which functions as an intermediate transfer unit. The example intermediate transfer unit of the imaging apparatus 1 may include a first belt roller 11, a second belt roller 12, an endless belt 13 which is an intermediate transfer belt, and a secondary transfer roller 14.

In addition to the intermediate transfer unit, the imaging apparatus 1 may include, for example, a plurality of process cartridges 3 including respective photoconductors 2, which are arranged along the movement direction of the endless belt 13 and a cassette 4 which accommodates a printing medium P of the imaging apparatus 1. As an example, each of the plurality of process cartridges 3 may include the photoconductor 2, a developing device, a charging device, and a cleaning device. In some examples, the imaging apparatus 1 includes a casing 5 to which the plurality of process cartridges 3 are attached and each process cartridge 3 may be attachable to and detachable from the casing 5 in such a manner that a door of the casing 5 is opened and the process cartridge is inserted into and extracted from the casing 5.

According to examples, the cassette 4 is opened and closed in order to accommodate the printing medium P. The printing medium P accommodated in the cassette 4 may be picked up and conveyed by a medium conveying device 6. The medium conveying device 6 may convey the printing medium P to a secondary transfer region R at a timing at which the toner image transferred to the endless belt 13 of the intermediate transfer unit of the imaging apparatus 1 reaches the secondary transfer region R.

As described above, the belt driving device 10 of the imaging apparatus 1 may be used as, for example, the transfer unit which secondarily transfers the toner image developed by the developing device. Additionally, a belt driving device may be used in a printing medium conveying unit that conveys the printing medium P. In this case, the endless belt of the belt driving device functions as a printing medium conveying belt which conveys the printing medium P.

Figure 2:
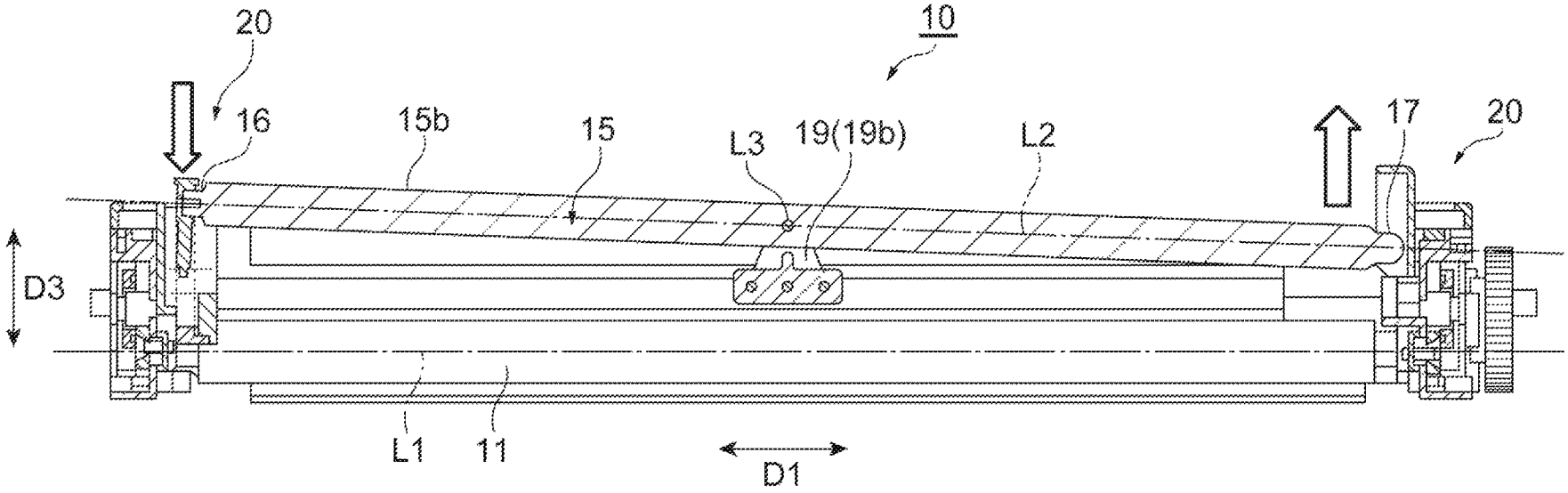
FIG. 2 is a lateral side view of a belt roller, a steering roller, and a steering roller actuator of an example belt driving device of the imaging system of FIG. 1, wherein portions thereof are schematically illustrated in cross-section.

FIG. 2 is a cross-sectional view illustrating the example belt driving device 10. As illustrated in FIGS. 1 and 2, the example belt driving device 10 includes a first belt roller 11, a second belt roller 12, and an endless belt 13 suspended between the first belt roller 11 and the second belt roller 12. The second belt roller 12 and the endless belt 13 are not illustrated in FIG. 2, in order to simplify the drawing.

According to an example, each of the first belt roller 11 and the second belt roller 12 extends in an axial direction D1. The axial direction D1 may correspond to the longitudinal direction of each of the first belt roller 11 and the second belt roller 12 and to the width direction of the endless belt 13. The first belt roller 11 and the second belt roller 12 may face each other in a direction D2 intersecting the axial direction D1.

According to an examples, the first belt roller 11 is a drive roller which drives the endless belt 13 and extends in the axial direction D1, and the second belt roller 12 is a driven roller which follows the driving of the first belt roller 11. As an example, the first belt roller 11 is a suspension roller which suspends (or supports) the endless belt 13. The first belt roller 11 receives, for example, power from the electric motor.

The first belt roller 11 is powered by the electric motor to rotate around an axis L1. As an example, the endless belt 13 which is suspended (or supported) on the first belt roller 11 and the second belt roller 12 moves circumferentially along the outer periphery of the first belt roller 11 and the outer periphery of the second belt roller 12 in the direction D2 in accordance with the rotation of the first belt roller 11.

The belt driving device 10 includes, for example, a steering roller 15 and a steering roller actuator 20 which correct a displacement of the endless belt 13 in the axial direction D1. The steering roller 15 is located at the inside of the endless belt 13 and extends in the axial direction D1. The steering roller 15 presses the endless belt 13 from the inside of the endless belt 13, in order to correct a displacement of the endless belt 13.

For example, the steering roller 15 is tiltable in order to adjust the meandering (or shifting) of the endless belt 13 in the axial direction D1. The steering roller 15 is provided between the first belt roller 11 and the second belt roller 12, and inside of the endless belt 13 so as to extend in the axial direction D1.

For example, the steering roller 15 may be disposed on the upstream side of the first belt roller 11 and the downstream side of the second belt roller 12 in the rotational movement direction of the endless belt 13. In this case, the steering roller 15 may be disposed so as to contact the inner peripheral surface of a portion of the endless belt 13 that moves from the second belt roller 12 to the first belt roller 11 in the rotational path of the endless belt 13. As an example, the steering roller 15 is disposed at a position near the first belt roller 11 in relation to the middle place of the first belt roller 11 and the second belt roller 12.

Figure 3:
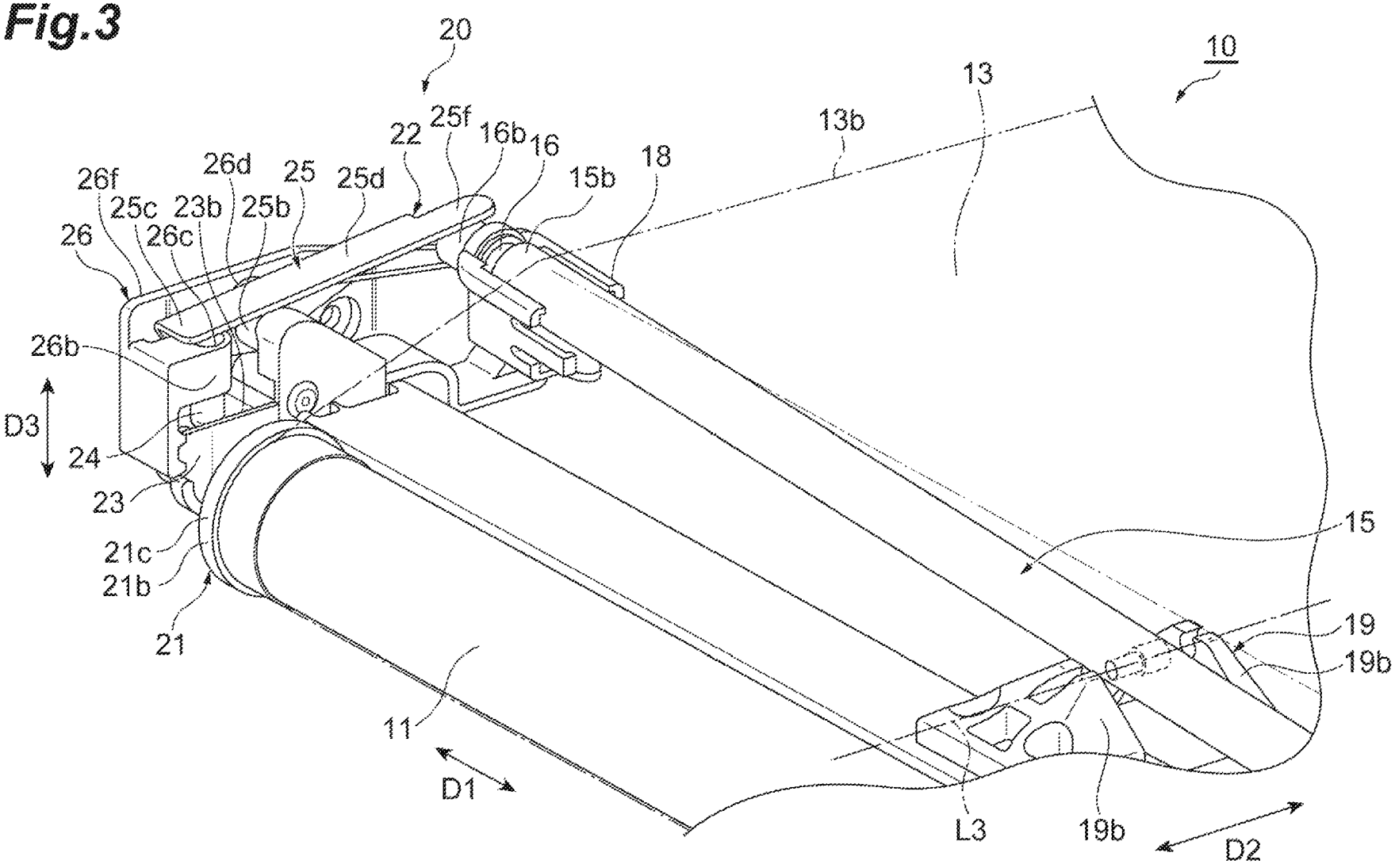
FIG. 3 is a perspective view of a portion of the example belt driving device of FIG. 2, illustrating the steering roller, the steering roller actuator, and an endless belt.

FIG. 3 is a perspective view illustrating the first belt roller 11, the endless belt 13, the steering roller 15, and the steering roller actuator 20. For ease of understanding, the endless belt 13 is schematically illustrated in broken lines, and the components located inside of the endless belt 13 are shown in solid lines. As illustrated in FIGS. 2 and 3, the steering roller actuator 20 is provided at the end portion of the first belt roller 11 in the axial direction D1 and an end portion 13*b* of the endless belt 13 contacts the steering roller actuator 20.

When the meandering endless belt 13 shifts outwardly in the axial direction D1, urges the steering roller actuator 20 to move in the axial direction D1 so as to cause the steering roller 15 to tilt relative to the axial direction D1. The steering roller actuator 20 includes a pulley 21 and a lever mechanism 22 which are provided in at least one of a first end portion 16 and a second end portion 17 of the steering roller 15. The pulley 21 moves in the axial direction D1 and, for example, the lever mechanism 22 moves the first end portion 16 in the vertical direction in accordance with the movement of the pulley 21 in the axial direction D1. The end portion 13*b* of the endless belt 13 is adjacent to the first end portion 16 of the steering roller 15.

The outer peripheral surface 15*b* of the steering roller 15 contacts, for example, the inner peripheral surface of the endless belt 13. As an example, the steering roller 15 rotates around an axis L2 in a driven manner in accordance with the rotational movement of the endless belt 13. The first end portion 16 and the second end portion 17 which are provided at respective ends of the steering roller 15, may be rotatably supported by a bearing. Each of the first end portion 16 and the second end portion 17 is movable in, for example, a direction D3 which is a vertical direction intersecting the axial direction D1.

The belt driving device 10 includes, for example, a support member 18 that is located at each of the opposite ends of the steering roller 15 in the axial direction D1 and a fixture 19 which fixes the steering roller 15 in a swingable (or pivotable) manner at the center of the steering roller 15 in the axial direction D1. The support member 18 supports, for example, each of the first end portion 16 and the second end portion 17 of the steering roller 15 and is disposed so as to cover the lower portion of each of the first end portion 16 and the second end portion 17.

The fixture 19 supports the steering roller 15 in a swingable manner. The fixture 19 includes a pair of facing portions 19*b* at opposite sides of the steering roller 15 in the direction D2. The steering roller 15 is swingable, for example, an axis L3 passing through the pair of facing portions 19*b* of the fixture 19 and extending in the direction D2.

In this case, each of the first end portion 16 and the second end portion 17 of the steering roller 15 swings in the direction D3 as the steering roller 15 swings around the axis L3. For example, when any one of the first end portion 16 and the second end portion 17 is pressed, the steering roller 15 is tiltable by using the pair of facing portions 19*b* as a fulcrum.

The example steering roller actuator 20 which tilts the steering roller 15 will be described. The pulley 21 of the steering roller actuator 20 has a substantially columnar or cylindrical shape. The pulley 21 includes a flange portion 21*b* which has a greater diameter so as to protrude radially, at the end portion in the axial direction D1. The pulley 21 is movable in the axial direction D1. An end surface (or circumferential end surface) 21*c* of the flange portion 21*b* facing outwardly in the radial direction protrudes radially outwardly in relation to the outer peripheral surface of the endless belt 13.

The example lever mechanism 22 includes a pressed portion 23 which is pressed by the pulley 21, an elevating portion 24 which contacts the pressed portion 23, a lever portion 25 which moves in the vertical direction in accordance with the elevation of the elevating portion 24, and a frame 26 which is provided with a holding member 26*b* located at the end portion of the belt driving device 10 in the axial direction D1 and which holds the elevating portion 24.

In an example, the pressed portion 23 is provided on the side opposite to the first belt roller 11 when viewed from the pulley 21 and moves along with the movement of the pulley 21 toward the end portion in the axial direction D1. The pressed portion 23 includes an inclined surface 23*b* which is inclined in both of the axial direction D1 and the direction D3 and, for example, the lower end of the elevating portion 24 contacts the inclined surface 23*b*.

The elevating portion 24 moves upward in the direction D3 in accordance with the movement of the inclined surface 23*b* toward the end portion in the axial direction D1. The elevating portion 24 has, for example, a round bar shape extending in the direction D3. As an example, the lower end of the elevating portion 24 is formed in a spherical surface shape. As a detailed example, the elevating portion 24 is held so as to be movable in the direction D3 by the holding member 26*b* of the frame 26 located at the side of the end portion in the axial direction D1. The holding member 26*b* includes an insertion hole 26*c* through which the elevating portion 24 is inserted. The elevating portion 24 is inserted through the insertion hole 26*c*, to limit the movement of the elevating portion 24 in the direction D3.

The example lever portion 25 includes a fulcrum 25*b* which is provided between the elevating portion 24 and the first end portion 16 (the second end portion 17) of the steering roller 15, a receiving portion 25*c* which receives a force applied toward the upper side of the elevating portion 24, an extension portion 25*d* which extends from the fulcrum 25*b* toward the first end portion 16 (the second end portion 17), and a pressing portion 25*f* which presses the first end portion 16 (the second end portion 17). As an example, the fulcrum 25*b* is supported by a support shaft 26*d* that is fixed to the frame 26. The support shaft 26*d* extends from an outer wall portion 26*f* of the frame 26 inwardly in the axial direction D1.

In an example, the fulcrum 25*b* is rotatably supported by the support shaft 26*d* while the support shaft 26*d* is inserted. For example, the receiving portion 25*c*, the fulcrum 25*b*, the extension portion 25*d*, and the pressing portion 25*f* are arranged in the direction D2 in this order. In this case, when the elevating portion 24 moves upward, the receiving portion 25*c* moves upward, and the extension portion 25*d* and the pressing portion 25*f* move downward. When the elevating portion 24 moves downward, the receiving portion 25*c* moved downward and the extension portion 25*d* and the pressing portion 25*f* move upward.

The first end portion 16 of the steering roller 15 includes, for example, a bearing accommodation portion 16*b* which accommodates the bearing of the steering roller 15 and the pressing portion 25*f* of the lever portion 25 contacts the surface of the bearing accommodation portion 16*b*. As an example, a spring which urges the bearing accommodation portion 16*b* upward may be accommodated in the lower portion of the bearing accommodation portion 16*b*. For example, when the pressing portion 25*f* moves downward, the bearing accommodation portion 16*b* moves the first end portion 16 of the steering roller 15 downward, so that the steering roller 15 is inclined (or tilted) downward toward the first end portion 16. When the bearing accommodation portion 16*b* and the pressing portion 25*f* move upward by the urging force of the spring, the first end portion 16 of the steering roller 15 is lifted upward such that the steering roller 15 is inclined (or tilted) upward toward the first end portion 16. When the first end portion 16 is moved downward, the steering roller 15 is tilted to move the second end portion 17 upward. When the first end portion 16 is inclined upward, the steering roller 15 is tilted to move the lower portion of the second end portion 17 downward.

By using the steering roller 15 and the steering roller actuator 20 with the above-described configuration, for example, when the end portion 13*b* of the endless belt 13 is displaced toward the pulley 21 (the first end portion 16 of the steering roller 15), the pulley 21 and the pressed portion 23 move toward the end portion in the axial direction D1 so that the elevating portion 24 moves upward and the pressing portion 25*f* of the lever portion 25 presses the first end portion 16 of the steering roller 15 downward.

When the first end portion 16 of the steering roller 15 is pressed downward, the steering roller 15 is tilted so that the second end portion 17 moves upward. When the first end portion 16 moves downward and the second end portion 17 moves upward, the tension of the endless belt 13 with respect to the second end portion 17 is increased to be greater than the tension of the endless belt 13 with respect to the first end portion 16. Consequently, the endless belt 13 moves toward the second end portion 17. Accordingly, the endless belt 13 which was initially displaced toward the first end portion 16 of the steering roller 15, moves toward the second end portion 17 via the steering roller actuator 20 (the pulley 21 and the lever mechanism 22) and the steering roller 15, so as to correct the displacement of the endless belt 13 toward the first end portion 16.

Accordingly, the steering roller 15 and the steering roller actuator 20 function as a belt position correction unit which corrects the positional displacement of the endless belt 13. The steering roller actuator 20 is provided in the first end portion 16 as described above, to cause the endless belt 13 which has been displaced toward the first end portion 16, to move toward the second end portion 17, so as to correct the positional displacement of the endless belt 13.

Figure 4:
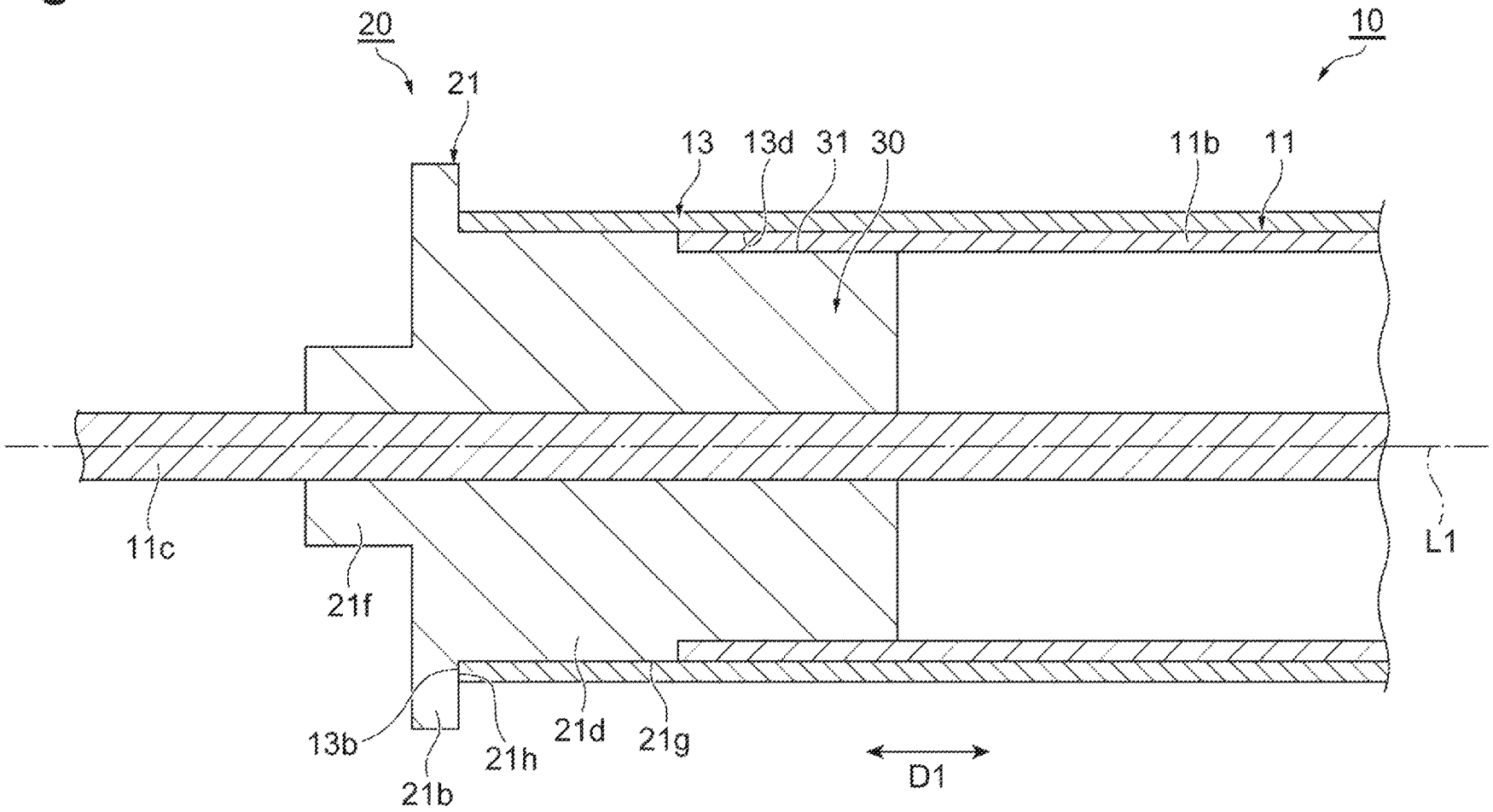
FIG. 4 is a cross-sectional view of a portion of the example belt driving device of FIG. 3 that is taken along a rotation axis of the belt roller, illustrating the belt roller, the endless belt, the steering roller actuator, and a support portion.

FIG. 4 is a schematic cross-sectional view illustrating the first belt roller 11, the endless belt 13, and the steering roller actuator 20 (the pulley 21). As illustrated in FIGS. 3 and 4, the first belt roller 11 includes a cylindrical rotation portion (or roller portion) 11*b* and a shaft 11*c* which extends along the axis L1 of the first belt roller 11. The endless belt 13 contacts the rotation portion 11*b* and rotates on the first belt roller 11.

The rotation portion 11*b* includes, for example, a tubular portion which is located at the inside of the first belt roller 11 in the radial direction and a rubber portion which covers the tubular portion. The tubular portion may be formed of, for example, aluminum, or may be formed of iron or resin according to other examples. The shaft 11*c* penetrates, for example, the pulley 21 in the axial direction D1.

In an example, the pulley 21 includes the flange portion 21*b*, a first tubular portion 21*d* which is located at one side of the flange portion 21*b* in the axial direction D1, and a second tubular portion 21*f* which is located at the other side of the flange portion 21*b* in the axial direction D1. An outer peripheral surface 21*g* which faces the outside of the first tubular portion 21*d* in the radial direction faces the endless belt 13 and the end portion (or edge portion) 13*b* of the endless belt 13 in the axial direction D1 contacts a side surface 21*h* facing the first tubular portion 21*d* in the flange portion 21*b*.

Figure 5:
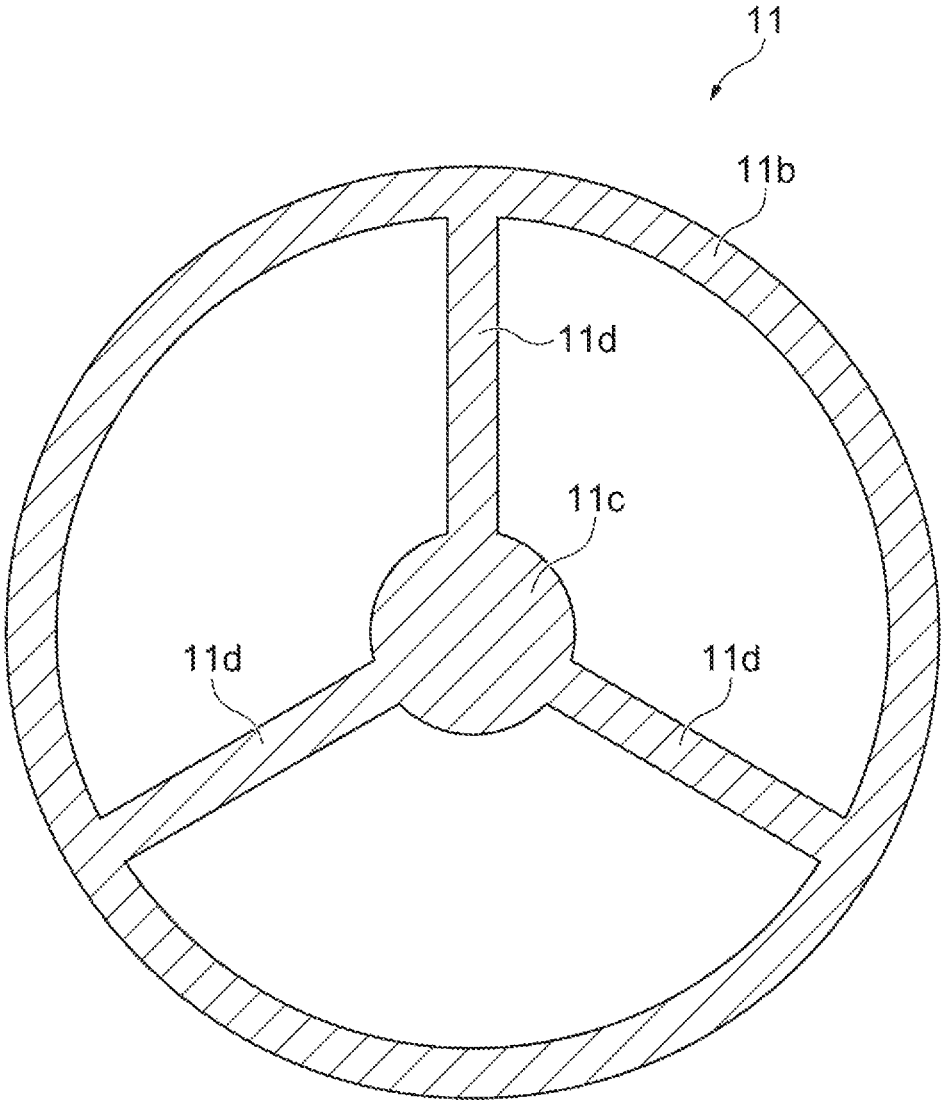
FIG. 5 is a lateral cross-sectional view of the example belt roller of FIG. 4.

FIG. 5 is a lateral or transverse cross-sectional view of the first belt roller 11 taken along a plane that orthogonal (e.g., transverse) to the axial direction D1. As illustrated in FIGS. 4 and 5, the first belt roller 11 as an example is, for example, a three-way tube so as to provide the first belt roller 11 with a simple configuration. The first belt roller 11 includes, for example, the rotation portion 11*b*, the shaft 11*c*, and three support portions 11*d* which extend from the shaft 11*c* outwardly in the radial direction of the first belt roller 11 and support the rotation portion 11*b*. Three support portions 11*d* are disposed so as to be arranged at the same interval, for example, in the rotation direction of the first belt roller 11.

Figure 6:
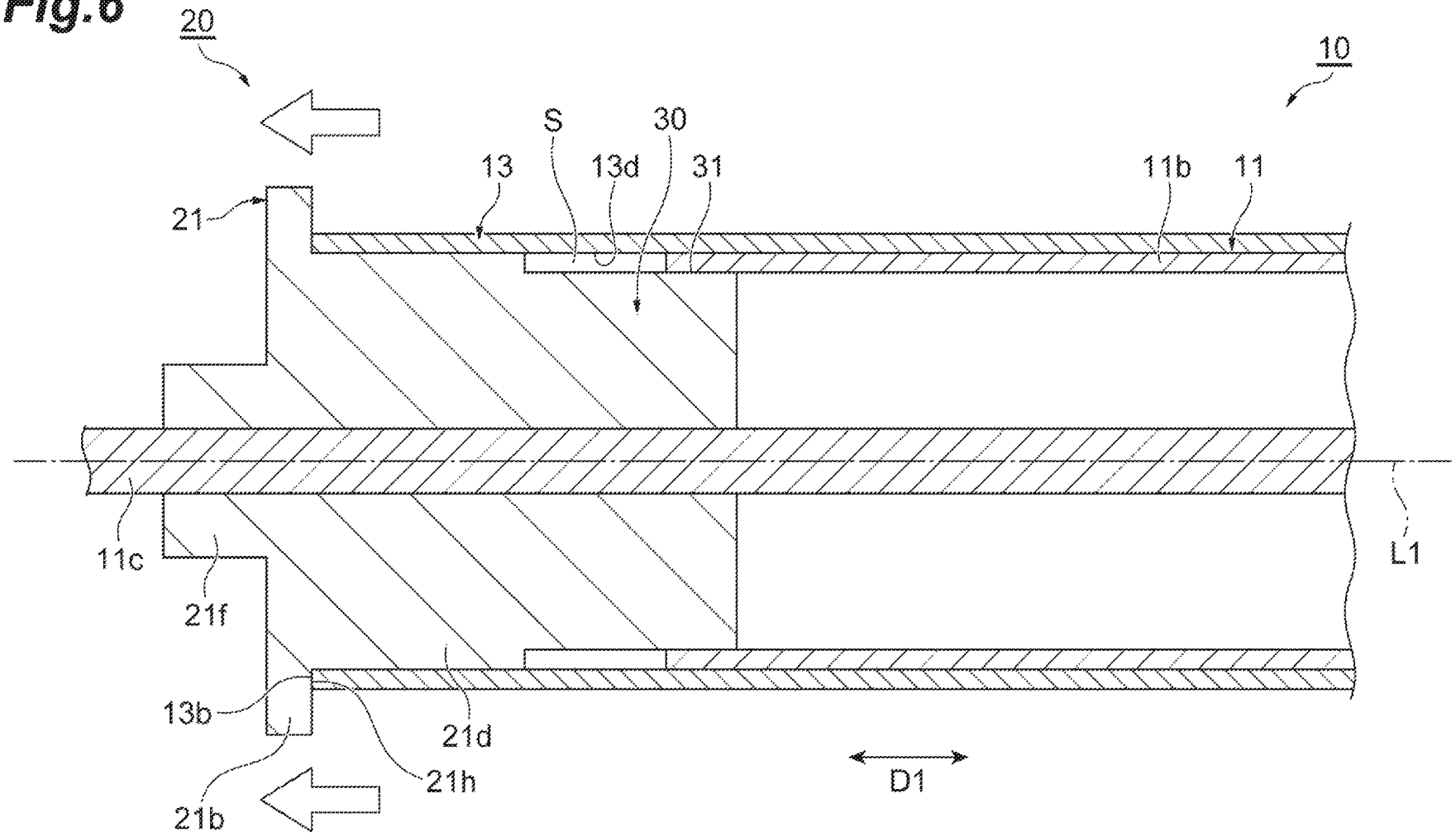
FIG. 6 is a cross-sectional view of the portion of the example belt driving device of FIG. 4, illustrating an example state in which the steering roller actuator and the support portion are moved away from the belt roller in an axial direction.

FIG. 6 illustrates an example of a state in which the endless belt 13 meanders in the axial direction D1 so as to urge the steering roller actuator 20 to shift in the axial direction D1. For example, the endless belt 13 that is in contact with the steering roller actuator 20 (the pulley 21), shifts, so that the steering roller actuator 20 moves in accordance with the shifting of the endless belt 13. The steering roller actuator 20 moves relative to the first belt roller 11 in the axial direction D1 so as to be separated (moved away) from the rotation portion 11*b* in response to the meandering (or shifting) of the endless belt 13, to tilt the steering roller 15.

As illustrated in FIGS. 4 and 6, the example belt driving device 10 includes an example support portion (or support) 30 which covers a gap S formed between the first belt roller 11 and the steering roller actuator 20 when the steering roller actuator 20 (the pulley 21) moves in the axial direction D1, so as to support the endless belt 13 at the gap S. The steering roller actuator 20 is movable, for example, in the axial direction D1 relative to the first belt roller 11 along with the support portion 30.

In some examples, the support portion 11*d* which forms a three-way tube may be recessed relative to the rotation portion 11*b* such that the support portion 11*d* does not extend to an installation position for the support portion 30 in the first belt roller 11. In this case, the support portion 30 extends into a portion of the first belt roller 11, where the support portion 11*d* of the first belt roller 11 forms a recess. The example support portion 30 is connected to the steering roller actuator 20. When the steering roller actuator 20 is separated (moved away) from the rotation portion 11*b*, the support portion 30 extends in the axial direction D1 across the gap S formed between the rotation portion 11*b* and the steering roller actuator 20 and faces the endless belt 13. The example support portion 30 covers the gap S from the inside of the endless belt 13 in the radial direction.

The support portion 30 supports the endless belt 13, for example, while extending into the rotation portion 11*b*. As an example, the support portion 30 is formed in a cylindrical shape and the shaft 11*c* penetrates the inside of the support portion 30 in the axial direction D1. The outer diameter of the support portion 30 may be smaller than the outer diameter of the pulley 21 (the first tubular portion 21*d*). The outer peripheral surface 31 of the support portion 30 faces the inner peripheral surface 13*d* of the endless belt 13.

The support portion 30 does not separate from the rotation portion 11*b*, even when the meandering endless belt 13 shifts the steering roller actuator 20 by a maximum distance along the axial direction D1, for example when the endless belt 13 in contact with the flange portion 21*b* of the steering roller actuator 20 shifts, such that the steering roller actuator 20 moves in the axial direction D1 to the maximum distance. Accordingly, even when the steering roller actuator 20 moves in the axial direction D1 to a maximum position by the meandering endless belt 13, the support portion 30 remains in overlap and in contact with the rotation portion 11*b* such that the gap S is overlapped by the support portion 30.

In a comparative example in which a steering roller actuator does not include any support portion, an endless belt may buckle in a gap that is formed between the steering roller actuator and a belt roller when the meandering endless belt contacts a flange portion of the steering roller actuator so as to move the steering roller actuator in the axial direction of the belt roller. For example, since the endless belt is not supported in the gap when the steering roller actuator moves away from the first belt roller, the endless belt may tend to bend in the gap. In this case, since the endless belt is deformed and/or an insufficient force is transmitted to the steering roller actuator by the endless belt, the steering roller may not be suitably tilted.

In the example steering roller actuator 20 including the support portion 30, the endless belt 13 is supported in the gap S by the support portion 30 even when the meandering endless belt 13 shifts the steering roller actuator 20 along the axial direction D1, for example when the endless belt in contact with the flange portion 21*b* of the steering roller actuator 20 shifts, to cause the steering roller actuator 20 to move in the axial direction D1. Accordingly, the endless belt 13 is supported in the gap S even when the steering roller actuator 20 is separated (e.g., moved away) from the first belt roller 11, so as to prevent the endless belt 13 from being bent in the gap S. Thus, the buckling of the endless belt 13 can be suppressed by the support portion 30.

As described above, the steering roller actuator 20 is movable in the axial direction D1 with respect to the first belt roller 11 along with the support portion 30 and the support portion 30 may support the endless belt 13 while extending into the rotation portion 11*b*. In this case, the support portion 30 extends from the steering roller actuator 20 and has a cylindrical box structure with respect to the rotation portion 11*b*, so as to simplify the structure of the support portion 30.

Figure 7:
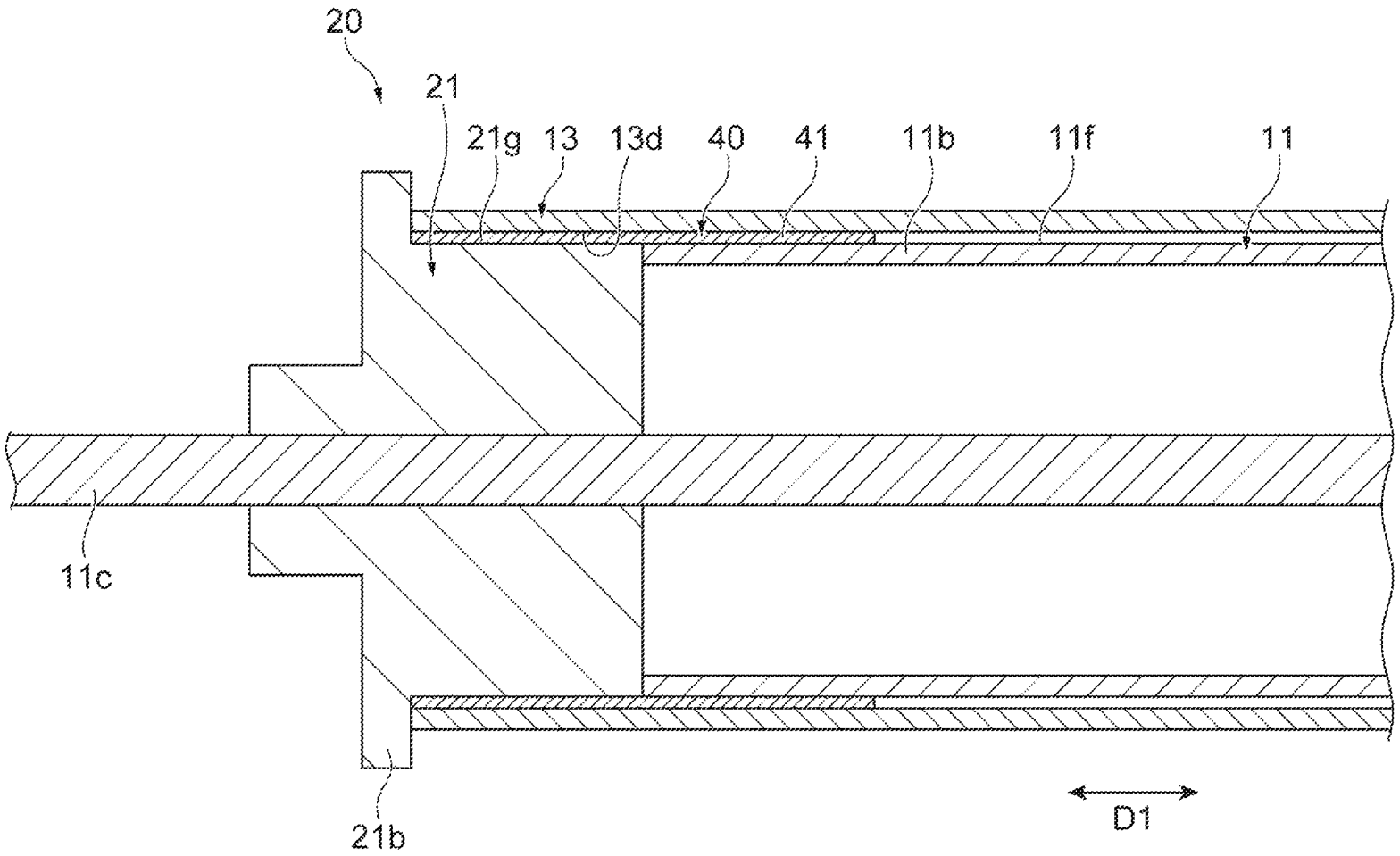
FIG. 7 is a cross-sectional view of a portion of an example belt driving device, illustrating a belt roller, an endless belt, a steering roller actuator, and a support portion.
Figure 8:
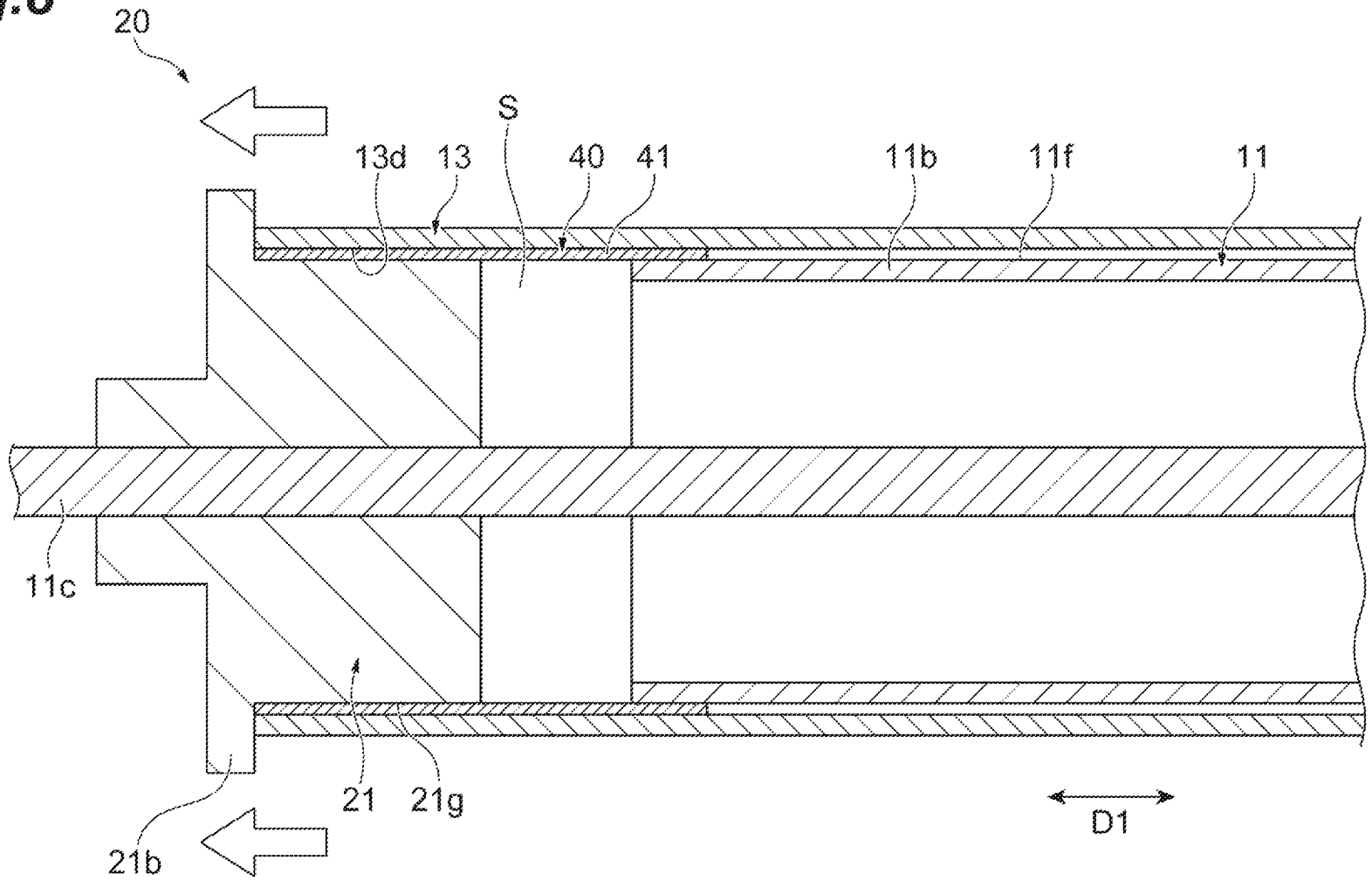
FIG. 8 is a cross-sectional view of the portion of the example belt driving device of FIG. 7, illustrating an example state in which the steering roller actuator and the support portion are moved away from the belt roller in the axial direction.

FIGS. 7 and 8 are cross-sectional views illustrating a steering roller actuator 20 with an example support portion (or support) 40, a first belt roller 11, and an endless belt 13 according to a modified example. The support portion 40 may be a tubular portion 41 located at the outside of the rotation portion 11*b* (e.g., located over the rotation portion 11*b* in the radial direction of the rotation portion 11*b*), to form a telescopic coupling that couples the support portion 40 with the belt roller 11. The tubular portion 41 may be formed in a film shape, such that a cross-section of the tubular portion 41 has a substantially thin thickness that is film-like. For example, the tubular portion 41 may be formed from a film material. The support portion 40 according to the modified example covers the gap S (cf. FIG. 8) from the inside of the endless belt 13 in the radial direction of the first belt roller.

For example, a first end of the tubular portion 41 in the axial direction D1 is sandwiched between the steering roller actuator 20 and the endless belt 13 and a second end of the tubular portion 41 in the axial direction D1 is sandwiched between the first belt roller 11 and the endless belt 13. Accordingly, the tubular portion 41 is sandwiched between the outer peripheral surface 21*g* of the pulley 21 and the inner peripheral surface 13*d* of the endless belt 13 at the first end, and is further sandwiched between the outer peripheral surface 11*f* of the first belt roller 11 and the inner peripheral surface 13*d* of the endless belt 13 at the second end.

The steering roller actuator 20 and the support portion 40 may be movable in the axial direction D1 with respect to the first belt roller 11. The support portion 40 is not separated from the rotation portion 11*b*. For example, even when the endless belt 13 shifts in contact with the flange portion 21*b* of the steering roller actuator 20 to cause the steering roller actuator 20 to move in the axial direction D1 to a maximum distance, the support portion 40 remains in contact with the rotation portion 11*b* so as to overlap the rotation portion 11*b*. Thus, even when the steering roller actuator 20 moves in the axial direction D1 to the maximum distance by the meandering endless belt 13, the support portion 40 overlaps the gap S that is formed between the pulley 21 and the first belt roller 11.

Accordingly, the support portion 40 supports the endless belt 13 in the gap S even when the meandering endless belt 13 urges the steering roller actuator 20 to shift outwardly in the axial direction D1, for example when the endless belt 13 in contact with the flange portion 21*b* of the steering roller actuator 20 shifts, such that the steering roller actuator 20 moves in the axial direction D1. Consequently, the endless belt 13 is supported in the gap S even when the steering roller actuator 20 is separated (e.g., moved away) from the first belt roller 11, so as to suppress or inhibit the bending of the endless belt 13 in the gap Sand the buckling of the endless belt 13.

Figure 9:
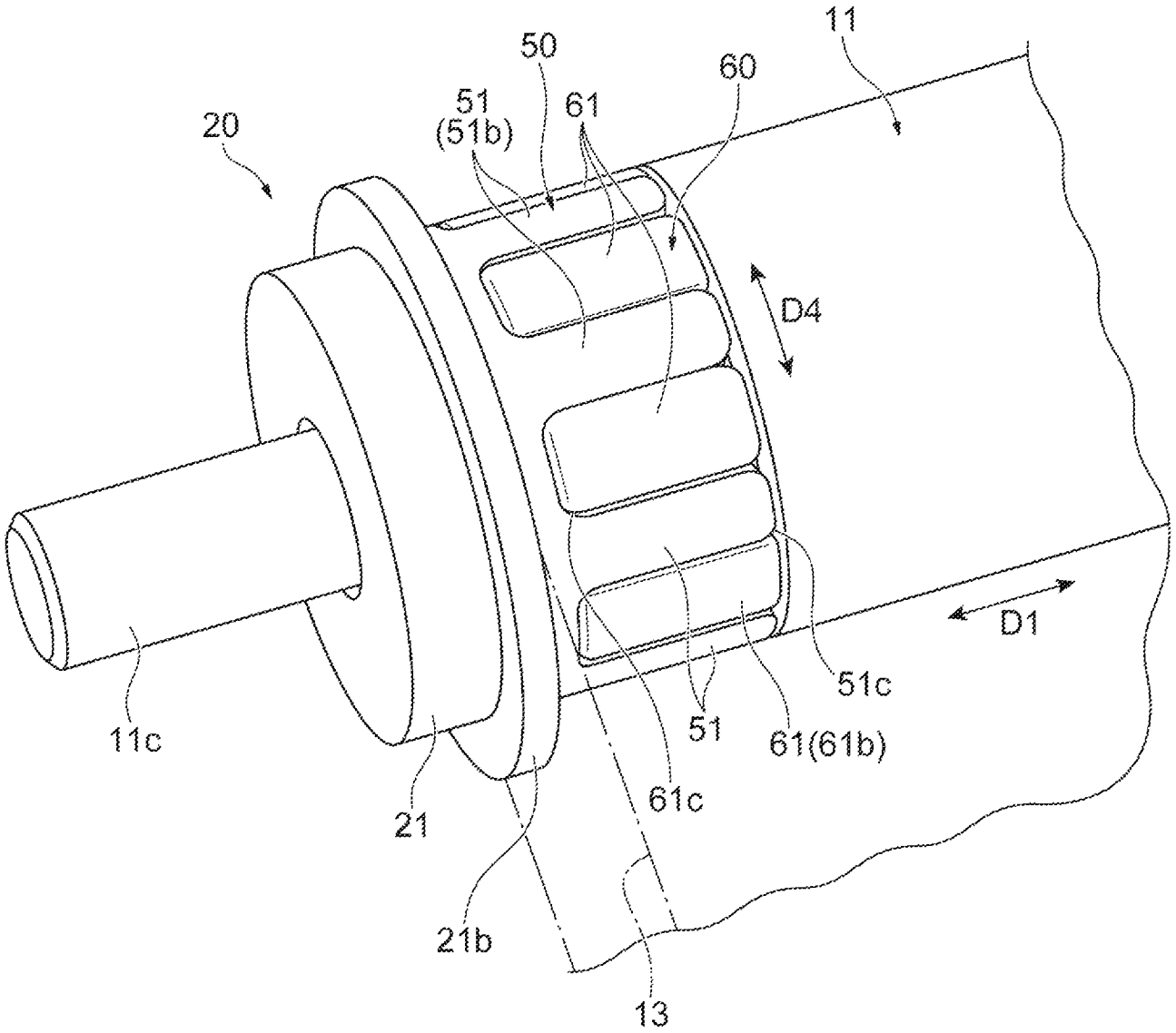
FIG. 9 is a perspective view of a portion of an example belt driving device, illustrating a steering roller actuator, an engagement member, and a belt roller.
Figure 10:
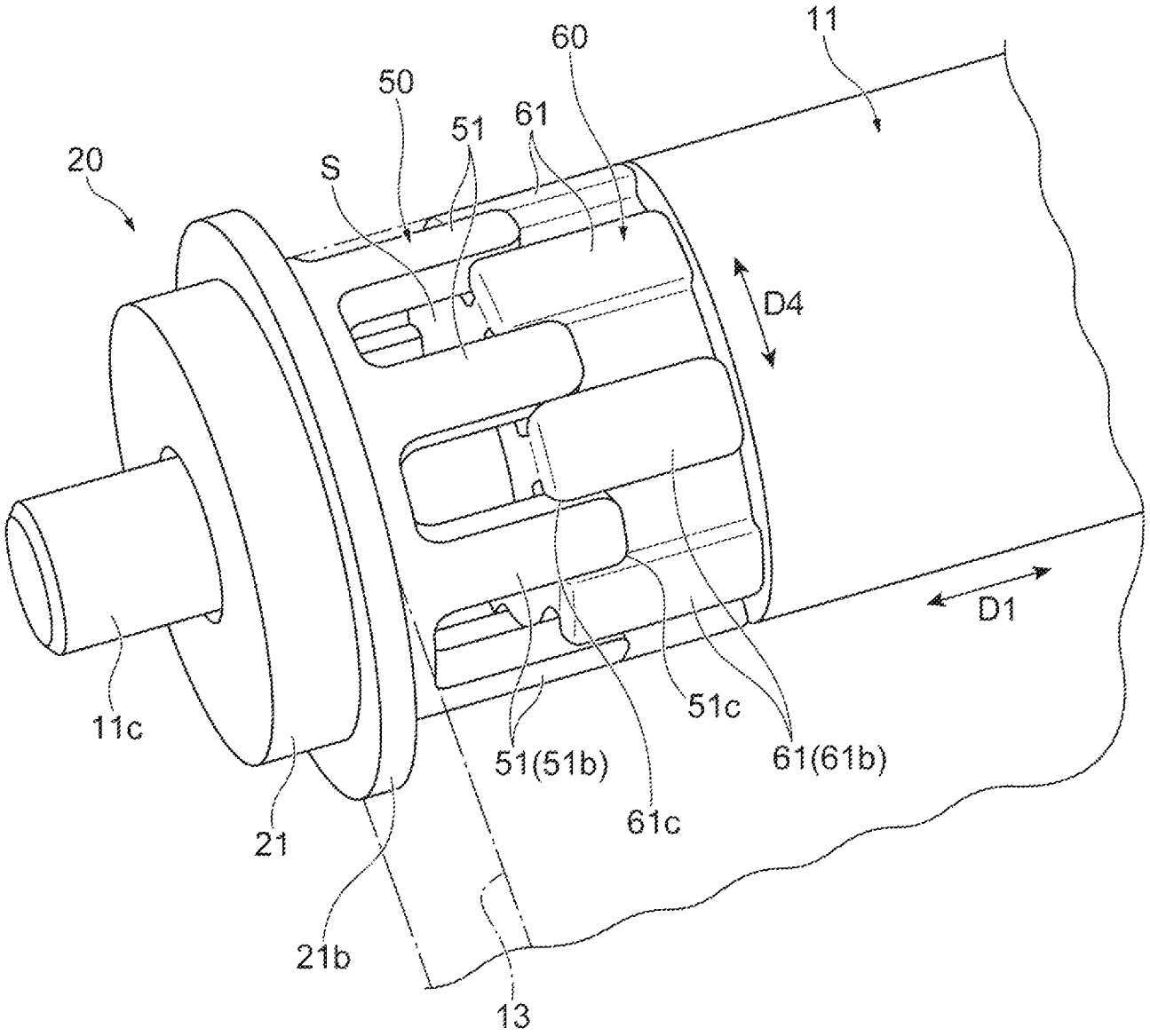
FIG. 10 is a perspective view of the portion of the example belt driving device of FIG. 9, illustrating an example state in which the steering roller actuator of FIG. 9 moves in the axial direction relative to the engagement member.

FIGS. 9 and 10 are perspective views illustrating an example support portion (or support) 50, the steering roller actuator 20, the first belt roller 11, and an example engagement member 60 according to another modified example. In FIGS. 9 and 10, in order to better illustrate the components inside of the endless belt 13, the endless belt 13 is illustrated in broken lines, and the support portion 50, the engagement member 60, and the first belt roller 11 located at the inside of the endless belt 13 are illustrated in solid lines.

According to an example, the support portion 50 includes a plurality of first convex portions (or first protrusions or first teeth) 51 which are arranged (e.g., spaced apart) in a rotation direction D4 of the first belt roller 11. For example, the support portion 50 has a comb shape including the plurality of first convex portions (or first protrusions or first teeth) 51 arranged in the rotation direction D4. The support portion 50 may, for example, extend from the steering roller actuator 20 (the pulley 21) toward the first belt roller 11, to support the endless belt 13.

The engagement member 60 may be fixed to the first belt roller 11. The engagement member 60 engages with the support portion 50 between the first belt roller 11 and the steering roller actuator 20. The engagement member 60 includes a plurality of second convex portions (or second protrusions or second teeth) 61 which are arranged (e.g., spaced apart) in the rotation direction D4 of the first belt roller 11 to be offset relative to the first convex portions 51. The second convex portions 61 may have a shape that is complementary to the shape of the first convex portions 51, to fit between two adjacent ones of the first convex portions 51.

In an example, an outer surface 51*b* of the first convex portion 51 is flush or level with an outer surface 61*b* of the second convex portion 61. For example, the first convex portion 51 and the second convex portion 61 are disposed so that the outer surface 51*b* and the outer surface 61*b* are arranged on substantially the same level in the radial direction of the of the first belt roller 11. The support portion 50 and the engagement member 60 may engage with each other in the axial direction D1. In a state in which the support portion 50 and the engagement member 60 are engaged with each other, the first convex portion 51 and the second convex portion 61 are alternately arranged in the rotation direction D4.

The first convex portion 51 and the second convex portion 61 may have a substantially rectangular shape, corner portions 51*c* of the first convex portion 51 and corner portion 61*c* of the second convex portion 61 being rounded, in order to inhibit or suppress the first convex portion 51 from interfering with the second convex portion 61 when the support portion 50 and the engagement member 60 engage with each other, in order to better guide and smoothen the movement of the support portion 50 relative to the engagement member 60.

The engagement member 60 is engaged with the support portion 50, for example, when each of the plurality of second convex portions 61 is inserted between two adjacent ones of the first convex portions 51. The steering roller actuator 20 and the support portion 50 are movable, for example, in the axial direction D1 with respect to the first belt roller 11 and the engagement member 60.

The support portion 50 is not separated from the engagement member 60, even when the meandering endless belt 13 urges the steering roller actuator 20 to shift by a maximum distance, for example when the endless belt 13 in contact with the flange portion 21*b* of the steering roller actuator 20 shifts, such that the steering roller actuator 20 moves in the axial direction D1 to the maximum distance. Accordingly, even when the steering roller actuator 20 moves in the axial direction D1 to the maximum distance by the meandering endless belt 13, the plurality of first convex portions 51 cover the gap S between the steering roller actuator 20 and the first belt roller 11.

Consequently, the support portion 50 supports the endless belt 13 in the gap S that forms between the steering roller actuator 20 and the first belt roller 11, even when the meandering endless belt 13 urges the steering roller actuator 20 to shift, for example when the endless belt that is in contact with the flange portion 21*b* of the steering roller actuator 20 shifts, to cause the steering roller actuator 20 to move in the axial direction D1. Consequently, the endless belt 13 is supported in the gap S even when the steering roller actuator 20 is separated (e.g., moved away) from the first belt roller 11, so as to suppress or inhibit the bending and the buckling of the endless belt 13 in the gap S.

In addition, the outer surface 51*b* of the first convex portion 51 of the support portion 50 may be flush or level with the outer surface 61*b* of the second convex portion 61 of the engagement member 60, so as to prevent the formation of a step between the support portion 50 and the engagement member 60 located at the inside of the endless belt 13, to more reliably suppress the bending and the buckling of the endless belt 13.

Figure 11:
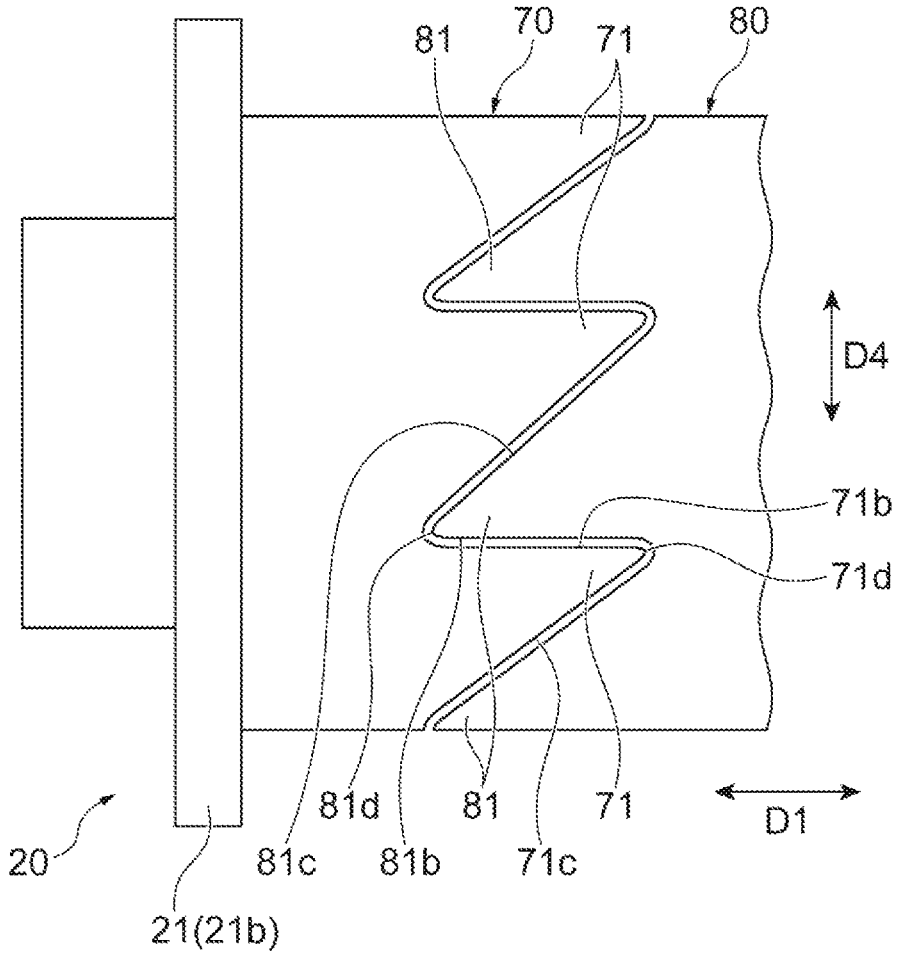
FIG. 11 is a side view of a portion of an example belt driving device, illustrating a steering roller actuator, a support portion, and an engagement member.
Figure 12:
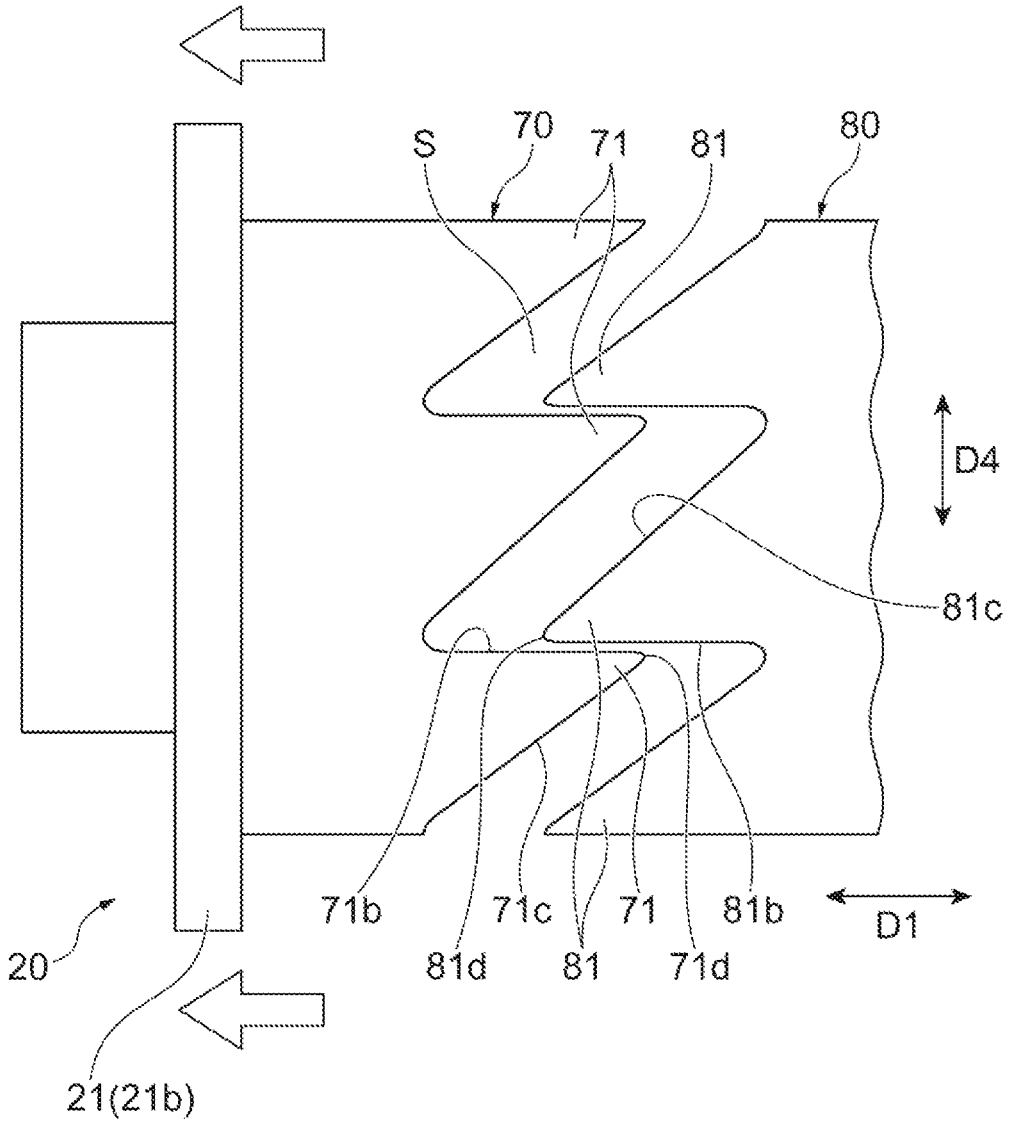
FIG. 12 is a side view of a portion of the example belt driving device of FIG. 11, illustrating an example state in which the steering roller actuator moves in the axial direction relative to the engagement member.

FIGS. 11 and 12 are side views illustrating an example support portion (or support) 70 and an example engagement member 80 according to still another modified example. The configurations of the support portion 70 and the engagement member 80 may respectively include some features similar to those of the configurations of the support portion 50 and the engagement member 60, described with reference to FIGS. 9 and 10.

The support portion 70 has a comb shape with a plurality of first convex portions (or first protrusions or first teeth) 71 arranged (e.g., spaced apart) in the rotation direction D4 and the engagement member 80 includes a plurality of second convex portions (or second protrusions or second teeth) 81 arranged (e.g., spaced apart) in the rotation direction D4 to be offset relative to the first convex portions 71. The second convex portions 81 may have a shape that is complementary to the shape of the first convex portions 71, to fit between two adjacent ones of the first convex portions 71. For example, the first convex portions 71 and the second convex portions 81 may form a triangular wave shape. Each of the first convex portions 71 includes a first side 71*b* which extends in the axial direction D1, a second side 71*c* which is angled with respect to the first side 71*b* (e.g., joining the first side 71*b* with a first side 71*b* of an adjacent first convex portion 71), and a vertex 71*d* which is formed by the intersection of the first side 71*b* and the second side 71*c*. The first side 71*b* and the second side 71*c* may be alternately arranged in the rotation direction D4 to form the triangular wave shape. The first side 71*b* and the second side 71*c* may be oriented to form an acute angle. Further, the vertex 71*d* may be rounded.

Each of the second convex portions 81 includes a first side 81*b* which extends in the axial direction D1, a second side 81*c* which is angled with respect to the first side 81*b* (e.g., joining the first side 81*b* with a first side 81*b* of an adjacent second convex portion 81), and a vertex 81*d* which is formed by the intersection of the first side 81*b* and the second side 81*c*. The shapes and the sizes of the first side 81*b*, the second side 81*c*, and the vertex 81*d* may be substantially the same as, for example, the shapes and the sizes of the first side 71*b*, the second side 71*c*, and the vertex 71*d* of the support portion 70. The engagement member 80 engages with the support portion 70 in such a manner that each of the second convex portions 81 fits between two adjacent ones of the first convex portions 71, and so that each of the first convex portions 71 fits between two adjacent ones of the second convex portions 81.

As described above, in the support portion 70 and the engagement member 80, the first convex portions 71 and the second convex portions 81 may form a triangular wave shape. The first convex portion 71 and the second convex portion 81 respectively include the first sides 71*b* and 81*b* which extend in the axial direction D1 and the second sides 71*c* and 81*c* which extend from the first sides 71*b* and 81*b* in an angular direction.

The triangular wave shape of the first convex portion 71 and the second convex portion 81 include the second sides 71*c* and 81*c*, respectively, which extend in an angular direction with respect to the axial direction D1, to reduce an area of the gap S exposed when the steering roller actuator 20 is separated (e.g., moved away) from the first belt roller 11, as compared with the case of the support portion 50 and the engagement member 60 described above with reference to FIGS. 9 and 10, so as to better suppress or inhibit the buckling of the endless belt 13.

In addition, the first convex portion 71 and the second convex portion 81 forming respective a triangular wave shapes include the first sides 71*b* and 81*b* that extend in the axial direction D1, to provide a contact between the first side 71*b* and the first side 81*b* so as to rotationally fix the support portion 70 with the engagement member 80 in the rotation direction D4. Accordingly, a relative rotation between the support portion 70 and the engagement member 80 can be suppressed or inhibited, so as to better suppress or inhibit the meandering of the endless belt 13.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

For example, in the description above, the example imaging apparatus 1 including the first belt roller 11, the second belt roller 12, and the steering roller 15 has been described. However, the number of the belt rollers may be one or three or more and the belt roller may also function as the steering roller. Accordingly, the configuration of the belt driving device can be appropriately modified and the configuration of each component of the imaging system or apparatus can be also appropriately modified.

The invention claimed is:

1. An imaging system comprising:

a belt roller extending in an axial direction;

an endless belt to rotate about the belt roller;

a steering roller located inside the endless belt and extending in the axial direction;

a steering roller actuator located at an end portion of the belt roller in the axial direction to contact the endless belt, wherein the steering roller actuator is displaceable in the axial direction in response to a shifting of the endless belt so as to tilt the steering roller with respect to the axial direction; and a support to support the endless belt and to overlap a gap formed between the belt roller and the steering roller actuator when the steering roller actuator is displaced in the axial direction.

2. The imaging system according to claim 1, wherein the support has a comb shape including support protrusions arranged in a rotation direction of the belt roller.

3. The imaging system according to claim 2, comprising:

an engagement member to engage with the support between the belt roller and the steering roller actuator, wherein the support protrusions form first protrusions, and wherein the engagement member includes second protrusions arranged in a rotation direction of the belt roller to fit each of the second protrusions between two adjacent ones of the first protrusions.

4. The imaging system according to claim 3, wherein an outer surface of the first protrusions is substantially level with an outer surface of the second protrusions, in a radial direction of the belt roller.

5. The imaging system according to claim 3, wherein the first protrusions and the second protrusions have a substantially rectangular shape.

6. The imaging system according to claim 3, wherein the first protrusions have shapes that are complementary to shapes of the second protrusions.

7. The imaging system according to claim 3, wherein the first protrusions and the second protrusions form a triangular wave shape.

8. The imaging system according to claim 7, wherein each of the first protrusions and the second protrusions includes a first side extending in the axial direction and a second side extending from the first side at an angle with respect to the axial direction.

9. The imaging system according to claim 1, wherein the support is coupled to the belt roller to be rotationally fixed with respect to the belt roller.

10. The imaging system according to claim 9, wherein the belt roller includes a cylindrical roller portion, and wherein the support is fitted into the roller portion.

11. The imaging system according to claim 9, wherein the belt roller includes a cylindrical roller portion, and wherein the support is a tubular portion located at the outside of the cylindrical roller portion to support the endless belt at the outside of the cylindrical roller portion.

12. The imaging system according to claim 11, wherein the tubular portion is formed from a film material.

13. The imaging system according to claim 1, wherein the steering roller actuator includes a pulley that is displaceable in the axial direction and a lever mechanism to move an end of the steering roller in a direction that is transvers to the axial direction in response to a movement of the pulley.

14. The imaging system according to claim 1, wherein the belt roller includes a three-way tube.

15. An imaging system comprising:

a belt roller extending in an axial direction, the belt roller including a roller portion;

an endless belt to rotate about the belt roller;

a steering roller located inside the endless belt, wherein the steering roller is tiltable to adjust a displacement of the endless belt in the axial direction;

a steering-roller actuator located at an axial end of the belt roller, wherein the steering-roller actuator contacts an edge of the endless belt, wherein the steering-roller actuator is displaceable in the axial direction of the belt roller to move away from the roller portion of the belt roller in response to the displacement of the endless belt, in order to tilt the steering roller; and a support coupled to the steering roller actuator at an axial end of the belt roller to face the endless belt and to overlap a gap formed between the roller portion and the steering roller actuator when the steering roller actuator is moved away from the roller portion.

* * * * *